US009404302B2

(12) United States Patent
Evensen

(10) Patent No.: US 9,404,302 B2
(45) Date of Patent: Aug. 2, 2016

(54) SYSTEMS AND METHODS FOR UNLOCKING/LOCKING AND OPENING/CLOSING WINDOWS

(75) Inventor: Kenneth R. Evensen, Naperville, IL (US)

(73) Assignee: REFLECTION WINDOW COMPANY, LLC, Chicago, IL (US)

( * ) Notice: Subject to any disclaimer, the term of this patent is extended or adjusted under 35 U.S.C. 154(b) by 448 days.

(21) Appl. No.: 13/540,878

(22) Filed: Jul. 3, 2012

(65) Prior Publication Data

US 2014/0007734 A1 Jan. 9, 2014

(51) Int. Cl.
*E05B 3/00* (2006.01)
*E05F 11/02* (2006.01)

(52) U.S. Cl.
CPC ..... *E05F 11/02* (2013.01); *Y10T 74/20582* (2015.01); *Y10T 74/20606* (2015.01)

(58) Field of Classification Search
CPC ..... E05F 11/02; Y10T 74/20582; Y10T 74/20606; Y10T 292/282; Y10T 16/473; E05B 1/0053
USPC ..... 292/256, 256.5, 256.65, 256.69, 336.3, 292/DIG. 20, DIG. 47, DIG. 49, 263; 49/394, 49/395
See application file for complete search history.

(56) References Cited

U.S. PATENT DOCUMENTS 949,359 A * 2/1910 Johnson ..... 292/263
2,295,778 A * 9/1942 Dwyer ..... 454/89
2,791,456 A 5/1957 Roehl
3,091,978 A 6/1963 Rubinstein
3,633,315 A 1/1972 Lorenz
3,927,492 A 12/1975 Carson
3,974,753 A 8/1976 Blomgren
4,086,727 A * 5/1978 Kuyper ..... E05C 17/32 292/263
4,136,578 A 1/1979 Van Klompenburg
4,195,866 A 4/1980 Tundo
4,206,939 A 6/1980 Rowley
4,257,632 A 3/1981 DeStepheno
4,300,794 A 11/1981 Dunsmoor
4,350,376 A 9/1982 Bascou
4,392,329 A * 7/1983 Suzuki ..... 49/356
4,435,007 A 3/1984 Bascou
4,466,644 A 8/1984 Wooten
4,469,370 A 9/1984 Petersen
4,484,773 A 11/1984 Lehne
4,534,587 A 8/1985 Fleming
4,615,236 A 10/1986 Boots
4,618,176 A 10/1986 Farmont (Continued)

*Primary Examiner* — Kristina Fulton
*Assistant Examiner* — Christine M Mills
(74) *Attorney, Agent, or Firm* — McAndrews, Held & Malloy, Ltd.

(57) ABSTRACT

Certain embodiments provide systems and methods for unlocking, opening, closing and locking a vent sash. The system may include a base configured to attach to one or more of a vent stop and a window frame. The system may include a lever pivotably or slidably attached to the base. The lever may be configured to pivotably attach to a locking mechanism interface of the vent sash. The lever may be configured to pivot substantially ninety degrees in a first direction to an unlocked position. The lever may be configured to pivot substantially ninety degrees in a second direction to an opened position. The lever may be configured to pivot substantially ninety degrees in a third direction to a closed position. The lever may be configured to pivot substantially ninety degrees in a fourth direction to a locked position.

23 Claims, 8 Drawing Sheets

(56) References Cited

U.S. PATENT DOCUMENTS

| | | | | |
|---|---|---|---|---|
| 4,923,232 | A | 5/1990 | Kawagoe | |
| 4,928,547 | A | 5/1990 | Huyer | |
| 4,937,976 | A | 7/1990 | Tucker | |
| 5,168,770 | A | 12/1992 | Ellis | |
| 5,201,241 | A | 4/1993 | Pollack | |
| 5,346,267 | A | 9/1994 | Betteridge | |
| 5,400,473 | A | 3/1995 | Delman | |
| 5,410,778 | A | 5/1995 | Langevin | |
| 5,438,801 | A | 8/1995 | Ishihara | |
| 5,467,503 | A | 11/1995 | Nolte | |
| 5,560,082 | A | 10/1996 | Vetter | |
| 5,740,632 | A | 4/1998 | Peterson | |
| 5,802,673 | A | 9/1998 | Nemeth | |
| 5,901,501 | A | 5/1999 | Fountaine | |
| 5,937,582 | A | 8/1999 | Taylor | |
| 6,032,990 | A | 3/2000 | Stone | |
| 6,035,492 | A | 3/2000 | Warshaviak | |
| 6,102,456 | A | 8/2000 | Boersman | |
| 6,164,156 | A | 12/2000 | Purcell | |
| 6,450,063 | B1 | 9/2002 | Harvey | |
| 6,598,265 | B2 * | 7/2003 | Lee | 16/429 |
| 6,612,628 | B1 | 9/2003 | Herbst | |
| 6,640,389 | B2 | 11/2003 | Van Klompenburg | |
| 6,908,124 | B2 | 6/2005 | Colicino | |
| 7,066,505 | B2 | 6/2006 | Van Klompenburg | |
| 7,147,256 | B2 | 12/2006 | Gill | |
| 7,194,930 | B2 | 3/2007 | Dawson | |
| 7,251,860 | B2 | 8/2007 | Liang | |
| 7,905,536 | B2 * | 3/2011 | Yue | 296/100.07 |
| 7,941,898 | B2 | 5/2011 | Liang | |
| 2004/0183314 | A1 * | 9/2004 | Klompenburg et al. | 292/263 |
| 2010/0038926 | A1 * | 2/2010 | Williamson et al. | 296/100.16 |

* cited by examiner

SYSTEMS AND METHODS FOR UNLOCKING/LOCKING AND OPENING/CLOSING WINDOWS

CROSS-REFERENCE TO RELATED APPLICATIONS/INCORPORATION BY REFERENCE

[Not Applicable]

FEDERALLY SPONSORED RESEARCH OR DEVELOPMENT

[Not Applicable]

MICROFICHE/COPYRIGHT REFERENCE

[Not Applicable]

FIELD OF THE INVENTION

Certain embodiments of the invention relate to systems and methods for unlocking/locking and opening/closing windows without excessive force and twisting. More specifically, certain embodiments provide a double-acting lever mechanism configured to unlock/lock an operable vent sash by pivoting substantially ninety degrees about a locking mechanism interface and configured to open/close the operable vent sash by pivoting an additional substantially ninety degrees about the locking mechanism interface. The force required to pivot the lever mechanism for any operation does not exceed five (5) pounds (lbs.).

BACKGROUND OF THE INVENTION

The Americans with Disabilities Act (ADA), which affects many public and private commercial buildings, is intended to ensure equal access to all persons regardless of physical disabilities. Section 309.4 of the ADA accessibility guidelines related to window and door hardware set forth that "[o]perable parts shall be operable with one hand and shall not require tight grasping, pinching, or twisting of the wrist. The force required to activate operable parts shall be 5 pounds (22.2 N) maximum." The Department of Justice Standards for Accessible Design (4.27.4) and the International Building Code (ANSI 309.4) set forth similar guidelines.

Architects prefer larger vents for exterior window designs to meet fresh air ventilation requirements. Using a larger quantity of smaller vents is typically more expensive than using a fewer quantity of larger vents. Additionally, current energy codes and specifications require low thermal insulating values for windows. Insulated glass has a better insulating value than metal, so the more metal used in a window system, the lower the insulating value. Because the exterior seal of a vent is subject to lower insulating values by nature and is a weak thermal point in the window system, a larger vent size helps to offset the overall insulating value due to the greater percentage of glass. A larger vent helps in the insulating performance but a larger vent takes more force to open.

Although using larger vents may improve insulating performance and decrease costs for architects, larger vents are typically more difficult to open and close. More specifically, an insulated glass unit weighs approximately seven (7) lbs. per square foot and can weigh as much as eight and one half (8.5) lbs. per square foot for laminated glass. When aluminum and other materials are added to construct the vent frame and sash, a vent can weigh around nine (9) lbs. per square foot. As such, a four (4) foot by five (5) foot vent may weigh approximately one hundred and eighty-nine (189) lbs. or more, which may be difficult to open using not more than five (5) lbs. of operational force as required by applicable ADA and other guidelines.

In addition to generally being more difficult to open and close, larger vents are also typically more difficult to lock and unlock. Vents, like other window systems, are manufactured and installed to meet strict air and water performance specifications. As such, to compress a sash to a vent frame of the window system, a great deal of compressive force can be needed to make the system air and water tight. The compression of the sash to the vent frame is commonly achieved by the locking of the sash using the vent handle, which moves one or more transmission bars inside a euro-grove (or vent track) around the perimeter of the sash when the vent handle is rotated in one direction.

For example, FIG. 1 is a diagram that illustrates an exemplary awning vent 100 with an exemplary locking mechanism as is known in the art. Referring to FIG. 1, the exemplary locking mechanism of the exemplary awning vent 100 may comprise, as an example, a handle 101, handle connectors 102, main transmission bars 103, transmission device connectors 104, 105, 110, corner transmission device housings 106, keepers 107, locking points 108, side transmission bars 109, and friction hinges 111. The handle 101 can attach to an inner portion of the sash. Certain components on an underside of the handle 101 may extend through the sash to an outer portion of the sash.

The handle connectors 102 may couple to the underside of the handle 101 at the outer portion of the sash and slidably fit in a euro-grove (not shown) that extends around an outer perimeter of the sash. Transmission bars 103 can attach to the handle connectors 102 at one end and corner transmission device connectors 104 at the other end, and may slidably fit in the euro-grove. The corner transmission device connectors 104 may slidably fit into corner transmission device housings 106. An outward, horizontal force on corner transmission device connectors 104 may cause the corner transmission device connectors 104 to extend into the corner transmission device housings 106, which in turn may cause the corner transmission device connectors 105 to extend vertically in the exemplary awning vent illustrated in FIG. 1.

Referring still to FIG. 1, side transmission bars 109 may attach to the corner transmission device connectors 105 at one end and transmission device connectors 110 at the other end, and may slidably fit in the euro-grove. Friction hinges 111 can attach to the sash and vent frame on both sides of the exemplary awning vent 100 and may be operable to guide and support the sash when venting as well as limit the opening range of the sash.

Locking points 108 may be attached to, or integrated with, one or more transmission bars 103, 109, or other components of the vent locking mechanism such as the transmission device connectors 104, 105, and 110, and may engage (or mate) with keepers 107, positioned at corresponding points on the vent frame, when moved by the handle 101 to the locking position. The engaging of the locking points 108 with the keepers 107 results in compression of the sash to the vent frame to make a tight seal. The larger the vent 100, the more locking points 108 and keepers 107 are needed to achieve an adequate seal. Further, the more locking points 108 and keepers 107, the more force is needed to lock and unlock the vent.

Many current vent designs for exterior windows require in excess of five (5) lbs. of force to open/close a sash. For example, many current vent designs do not use any mechanisms to open/close a sash (e.g., push open and pull closed), which may require more than five (5) lbs. of force, particularly for larger vents. Further, current vent designs that do have mechanisms for opening/closing a sash may not alleviate the force necessary to open/close the sash to meet the ADA guidelines. Instead, some mechanisms, such as cranks, not only may require more force to open, but also require excessive twisting. Additionally, many current vent designs for exterior windows require in excess of five (5) lbs. of force to lock/unlock a sash, particularly for larger vents having locking mechanisms with more locking points.

As such, there is a need for providing systems and methods for unlocking/locking and opening/closing windows without excessive force and twisting.

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

Systems and methods for unlocking/locking and opening/closing windows without excessive force and twisting is provided, substantially as shown in and/or described in connection with at least one of the figures, as set forth more completely in the claims.

These and other advantages, aspects and novel features of the present invention, as well as details of an illustrated embodiment thereof, will be more fully understood from the following description and drawings.

Figure 1:
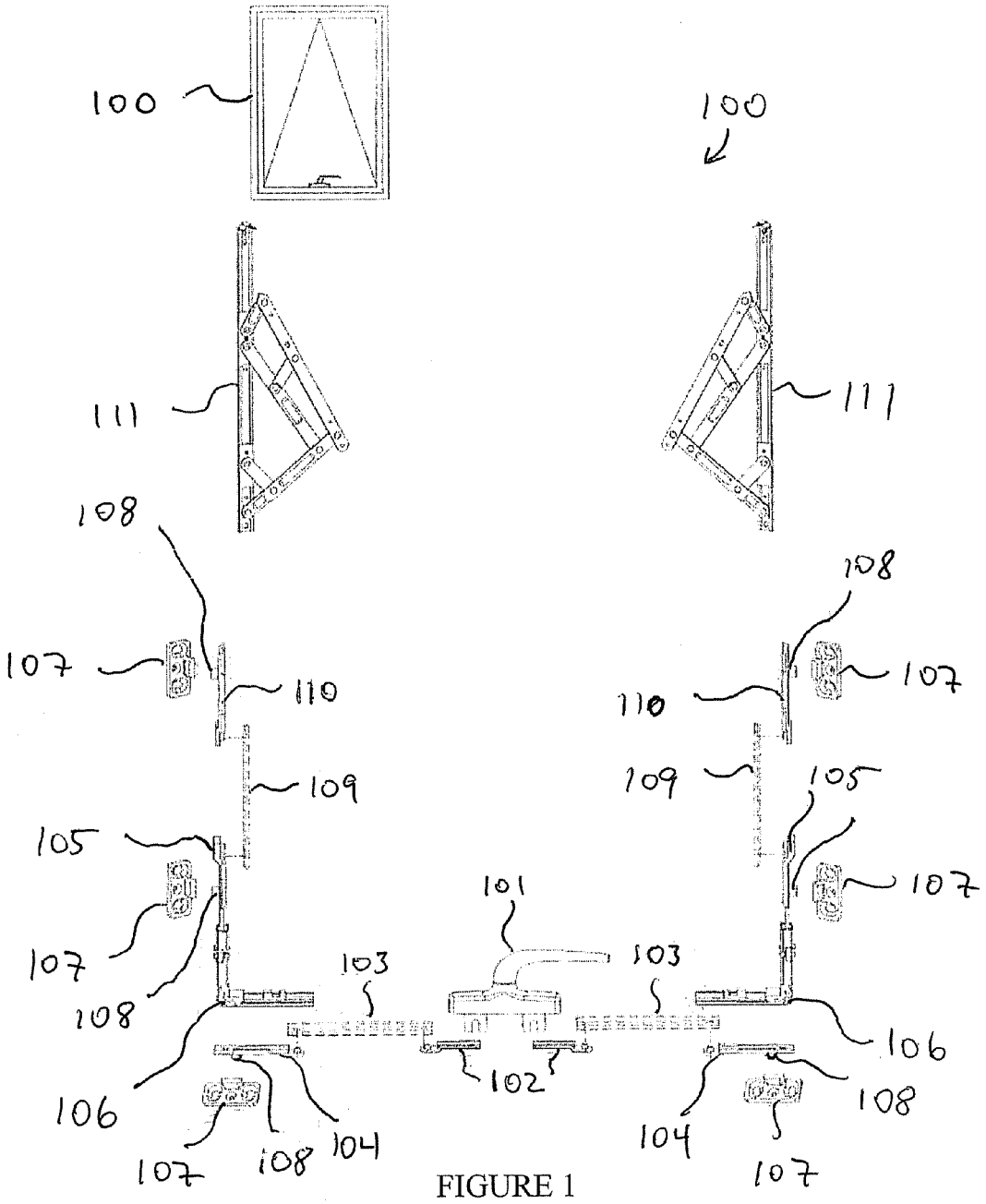
FIGURE 1 (Prior Art)
FIG. 1 is a diagram that illustrates an exemplary awning vent with an exemplary locking mechanism as is known in the art.

The foregoing summary, as well as the following detailed description of certain embodiments of the present invention, may be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION

Certain embodiments of the invention may be found in systems and methods for unlocking/locking and opening/closing windows without excessive force and twisting. More specifically, certain embodiments provide a double-acting lever mechanism 200 configured to unlock/lock an operable vent sash by pivoting substantially ninety degrees about a locking mechanism interface 101 and configured to open/close the operable vent sash by pivoting an additional substantially ninety degrees about the locking mechanism interface 101. The force required to pivot the lever mechanism 200 for any operation does not exceed five (5) pounds (lbs.).

Various embodiments provide a lever mechanism system 200 for unlocking, opening, closing and locking a vent sash 310. The lever mechanism system 200 may comprise a base 220, 230 configured to fixably attach to at least one of a vent stop 330 and a window frame 400. The lever mechanism system 200 may comprise a lever 210 rotatably or slidably attached to the base 220, 230. The lever 210 may be configured to pivotably attach to a locking mechanism interface 101 of the vent sash 310. The lever 210 may be configured to pivot substantially ninety degrees in a first direction to an unlocked position. The lever 210 may be configured to pivot substantially ninety degrees in a second direction to an open position. The lever 210 may be configured to pivot substantially ninety degrees in a third direction to a closed position. The lever 210 may be configured to pivot substantially ninety degrees in a fourth direction to a locked position.

Certain embodiments provide a method 800 for unlocking, opening, closing and locking a vent sash 310. The method may comprise pivoting 810 a lever 210 substantially ninety degrees in a first direction to an unlocked position. The method 800 may comprise pivoting 820 the lever 210 substantially ninety degrees in a second direction to an open position. The method 800 may comprise pivoting 830 the lever 210 substantially ninety degrees in a third direction to a closed position. The method 800 may comprise pivoting 840 the lever 210 substantially ninety degrees in a fourth direction to a locked position.

Although certain embodiments in the foregoing description may be described in reference to awning vents, unless so claimed, the scope of various aspects of the present invention should not be limited to awning vents and may additionally and/or alternatively be applicable to casement vents, hopper vents, or any suitable vent. Further, although the viewpoint of FIGS. 2-7 appears as though the double-acting lever mechanism is attaching to or replacing a handle at a base of a vent, the scope of various aspects of the present invention should not be limited to the viewpoint of the handle and/or double-acting lever mechanism being positioned at a base of a vent and may additionally and/or alternatively be a viewpoint of the handle and/or double-acting lever mechanism being positioned at any side and position along the perimeter of the vent. Additionally, although certain embodiments in the foregoing description may describe the double-acting lever mechanism as interacting with a euro-grove/transmission bar locking system as illustrated in FIG. 1, for example, unless so claimed, the scope of various aspects of the present invention should not be limited to euro-grove/transmission bar locking systems and may additionally and/or alternatively be applicable to any suitable vent locking system.

Figure 2:
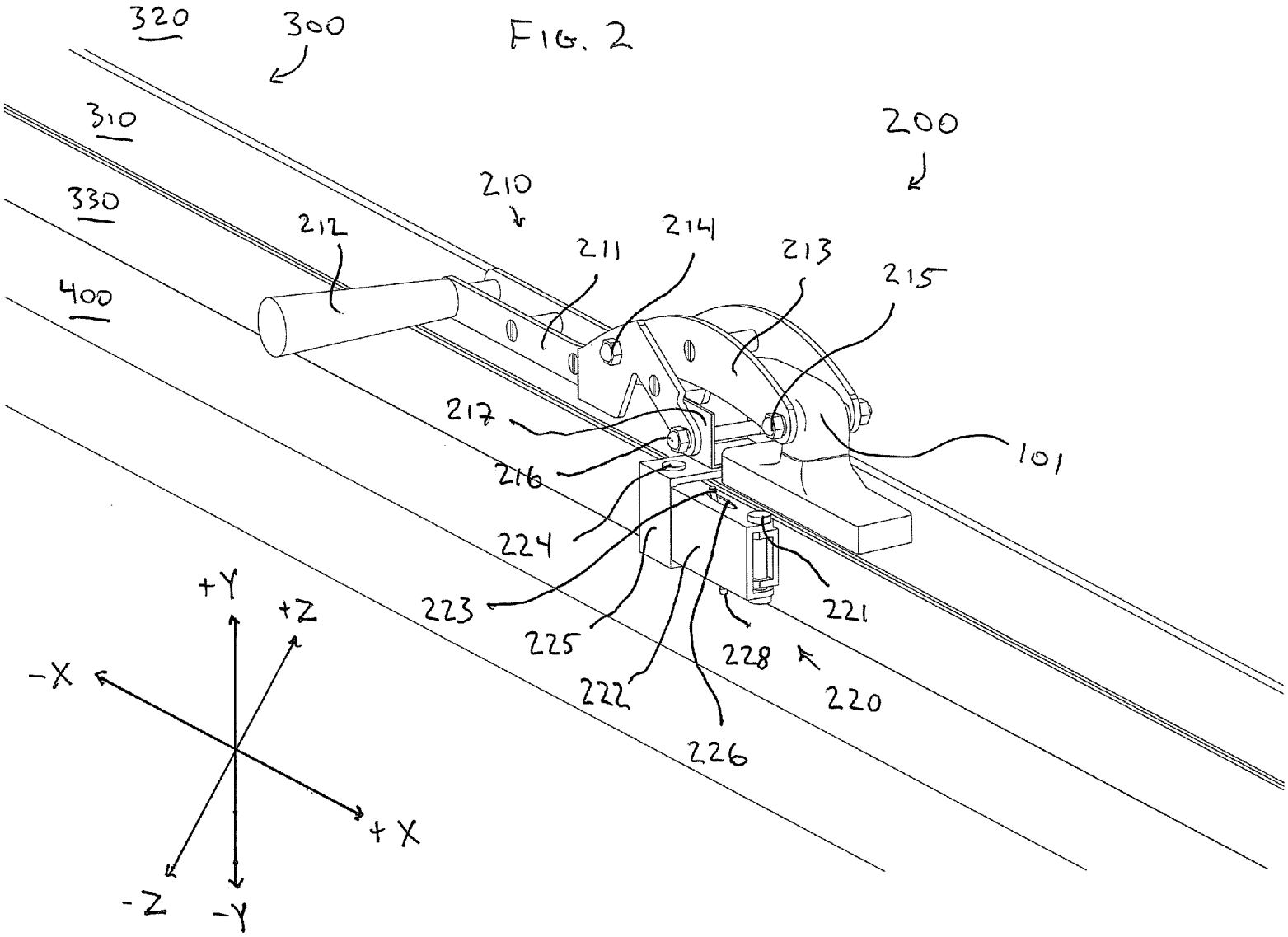
FIG. 2 is a diagram that illustrates a perspective view of an exemplary double-acting lever mechanism in a locked/closed position and comprising an exemplary lever and an exemplary swing arm base in accordance with an embodiment of the present invention.
Figure 3:
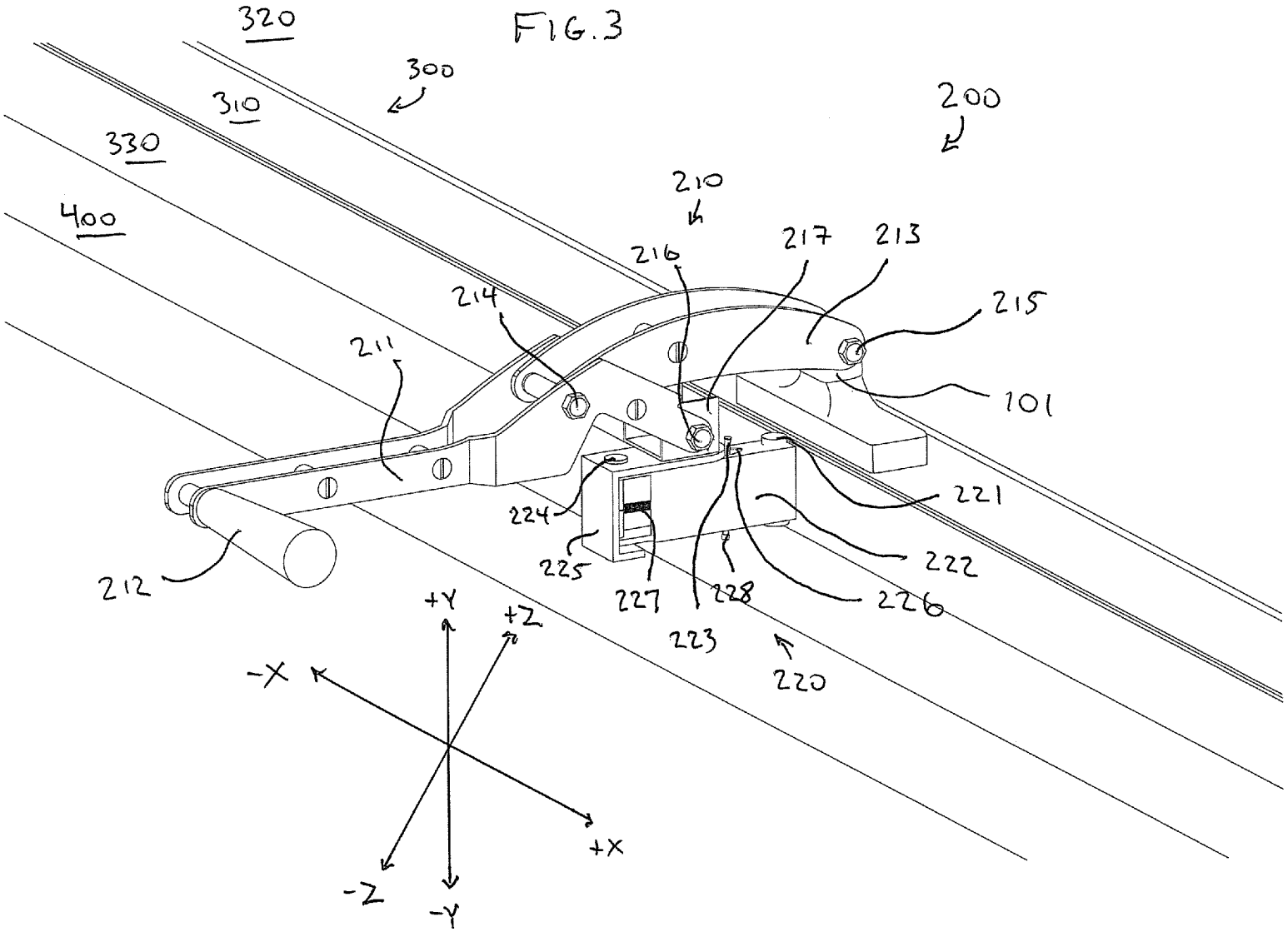
FIG. 3 is a diagram that illustrates a perspective view of an exemplary double-acting lever mechanism in an unlocked/closed position and comprising an exemplary lever and an exemplary swing arm base in accordance with an embodiment of the present invention.
Figure 4:
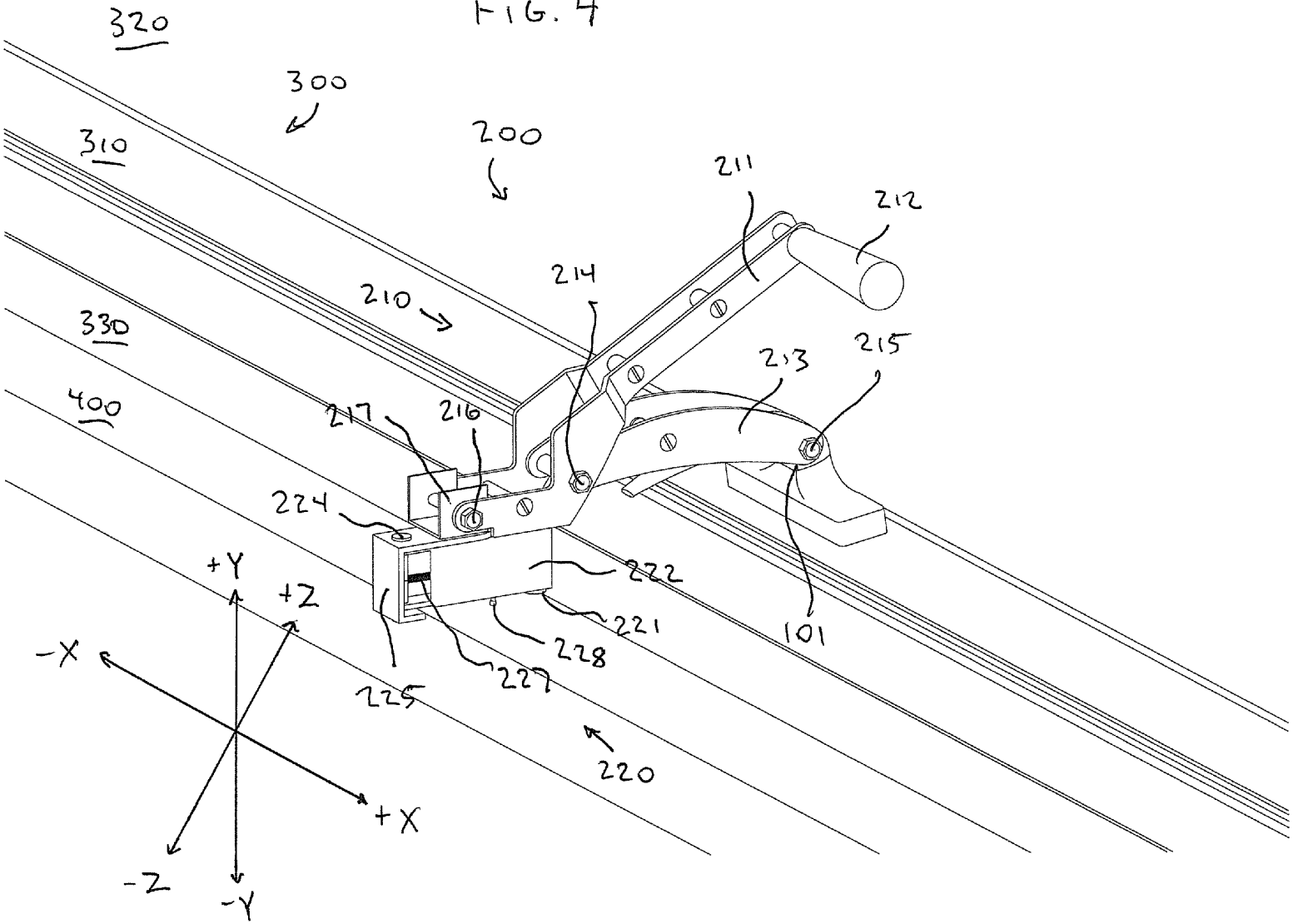
FIG. 4 is a diagram that illustrates a perspective view of an exemplary double-acting lever mechanism in an unlocked/open position and comprising an exemplary lever and an exemplary swing arm base in accordance with an embodiment of the present invention.

FIG. 2 is a diagram that illustrates a perspective view of an exemplary double-acting lever mechanism 200 in a locked/closed position, and comprising an exemplary lever 210 and an exemplary swing arm base 220 in accordance with an embodiment of the present invention. FIG. 3 is a diagram that illustrates a perspective view of an exemplary double-acting lever mechanism 200 in an unlocked/closed position, and comprising an exemplary lever 210 and an exemplary swing arm base 220. FIG. 4 is a diagram that illustrates a perspective view of an exemplary double-acting lever mechanism 200 in an unlocked/open position, and comprising an exemplary lever 210 and an exemplary swing arm base 220.

Referring to FIGS. 2-4, there is shown an exemplary double-acting lever mechanism 200 comprising an exemplary lever 210 and an exemplary swing arm base 220. Also illustrated in FIGS. 2-4 are a window frame 400 and a vent 300. The vent can comprise a sash 310, glass 320 and vent stop 330, for example. The exemplary double-acting lever mechanism 200 is illustrated in three-dimensions comprising an X axis, a Y axis and a Z axis. The −X direction refers to the left direction, for example. The +X direction refers to the right direction, for example. The −Y direction refers to the down direction, for example. The +Y direction refers to the up direction, for example. The −Z direction refers to the direction away from the glass 320, for example. The +Z direction refers to the direction toward the glass 320, for example. Although certain embodiments in the foregoing description may be described in reference to the various directions corresponding to left/right/down/up/away/toward, for example, the directions may correspond differently depending on the viewpoint and/or the positioning of the lever mechanism 200 with respect to the vent 300.

The swing arm base 220 may comprise a main swing arm pivot 221, a swing arm housing 222, a detent pin 223, a secondary swing arm pivot 224 and a secondary swing arm pivot support 225. The main swing arm pivot 221 may be a pin, screw or any suitable pivotable attachment mechanism. The main swing arm pivot 221 attaches and extends through the swing arm housing 222 and attaches to one or more of the vent stop 330 of the vent 300, and the window frame 400. The main swing arm pivot 221 supports the swing arm housing 222 when pivoting substantially ninety (90) degrees (i.e., 85-95 degrees) in the +X/−Z and −X/+Z directions, for example, between locked (as illustrated in FIG. 2) and unlocked (as illustrated in FIG. 3) positions. Further, the main swing arm pivot 211 supports a fulcrum 216 when the lever 210 pivots substantially ninety (90) degrees (i.e., 85-95 degrees) in the +Y/+Z and −Y/−Z directions, for example, between unlocked/closed (as illustrated in FIG. 3) and open (as illustrated in FIG. 4) positions as discussed in more detail below.

Certain embodiments provide that the swing arm housing 222 couples to the main swing arm pivot 221 and the secondary swing arm pivot 224. The secondary swing arm pivot 224 may be a pin, screw or any suitable pivotable attachment mechanism. The swing arm housing 222 may fit partially and rotatably within the secondary swing arm pivot support 225, which also attaches to the secondary swing arm pivot 224, at a secondary swing arm pivot 224 end of the swing arm housing 222. In certain embodiments, the swing arm housing 222 comprises grooves 226 on top and bottom portions of the swing arm housing 222 such that a detent pin 223 can extend through the swing arm housing 222 and be movable within grooves 226. In certain embodiments, material such as rubber or plastic may wrap around a bottom end of the detent pin 223 that extends through the bottom groove of the swing arm housing 222, such that a support leg 228 is formed to contact the window frame 400 when in the unlocked positions (as illustrated in FIGS. 3-4) such that the swing arm base 220 is stabilized on the window frame 400 by the support leg 228. Additionally and/or alternatively, a support stop (not shown) may be fixably attached to the window frame 400 for engaging or wedging under the swing arm base 220 when the swing arm base is in the unlocked positions (as illustrated in FIGS. 3-4).

In various embodiments, the swing arm housing 222 houses a spring 227 and the portions of the detent pin 223, main swing arm pivot 221 and secondary swing arm pivot 224 that extend through swing arm housing 222. The spring 227 attaches to the secondary swing arm pivot 224 and the detent pin 223 within the housing, biasing the detent pin 223 towards a secondary swing arm pivot end of grooves 226.

In certain embodiments, the spring arm base 220 attaches to lever 210 at a fulcrum connection 217 as discussed in more detail below.

In operation, when moving the lever mechanism 200 substantially ninety (90) degrees in the +X/−Z direction from a locked position (as illustrated in FIG. 2) to an unlocked position (as illustrated in FIG. 3), the swing arm base 220 pivots about the main swing arm pivot 221. Further, the secondary swing arm pivot support 225 pivots about the secondary swing arm pivot 224. The swing arm pivot support 225 contacts and biases the detent pin 223 towards a main swing arm pivot end of grooves 226, which locks and stabilizes the lever mechanism 200 in the unlocked position (as illustrated in FIGS. 3-4). At the same time, the biasing of the detent pin 223 towards the main swing arm pivot end of grooves 226 by the secondary swing arm pivot support 225 causes the support leg 228 portion of the detent pin 223 to contact the window frame 400, which provides further locking and stabilization of the lever mechanism 200 in the unlocked position (as illustrated in FIGS. 3-4).

Inversely, when moving the lever mechanism 200 substantially ninety (90) degrees in the −X/+Z direction from an unlocked position (as illustrated in FIG. 3) to a locked position (as illustrated in FIG. 2), the swing arm base 220 pivots about the main swing arm pivot 221. Further, the secondary swing arm pivot support 225 pivots about the secondary swing arm pivot 224. The swing arm pivot support 225 pivots away from the detent pin 223, allowing the detent pin 223 to bias towards the secondary swing arm pivot end of grooves 226, which releases the locking and stabilization of the lever mechanism 200 such that it may pivot to the locked position (as illustrated in FIG. 2). At the same time, the biasing of the detent pin 223 back towards the secondary swing arm pivot end of grooves 226 releases the support leg 228 portion of the detent pin 223 from its contact with the window frame 400, which allows the lever mechanism 200 to pivot to the locked position (as illustrated in FIG. 2).

Figure 5:
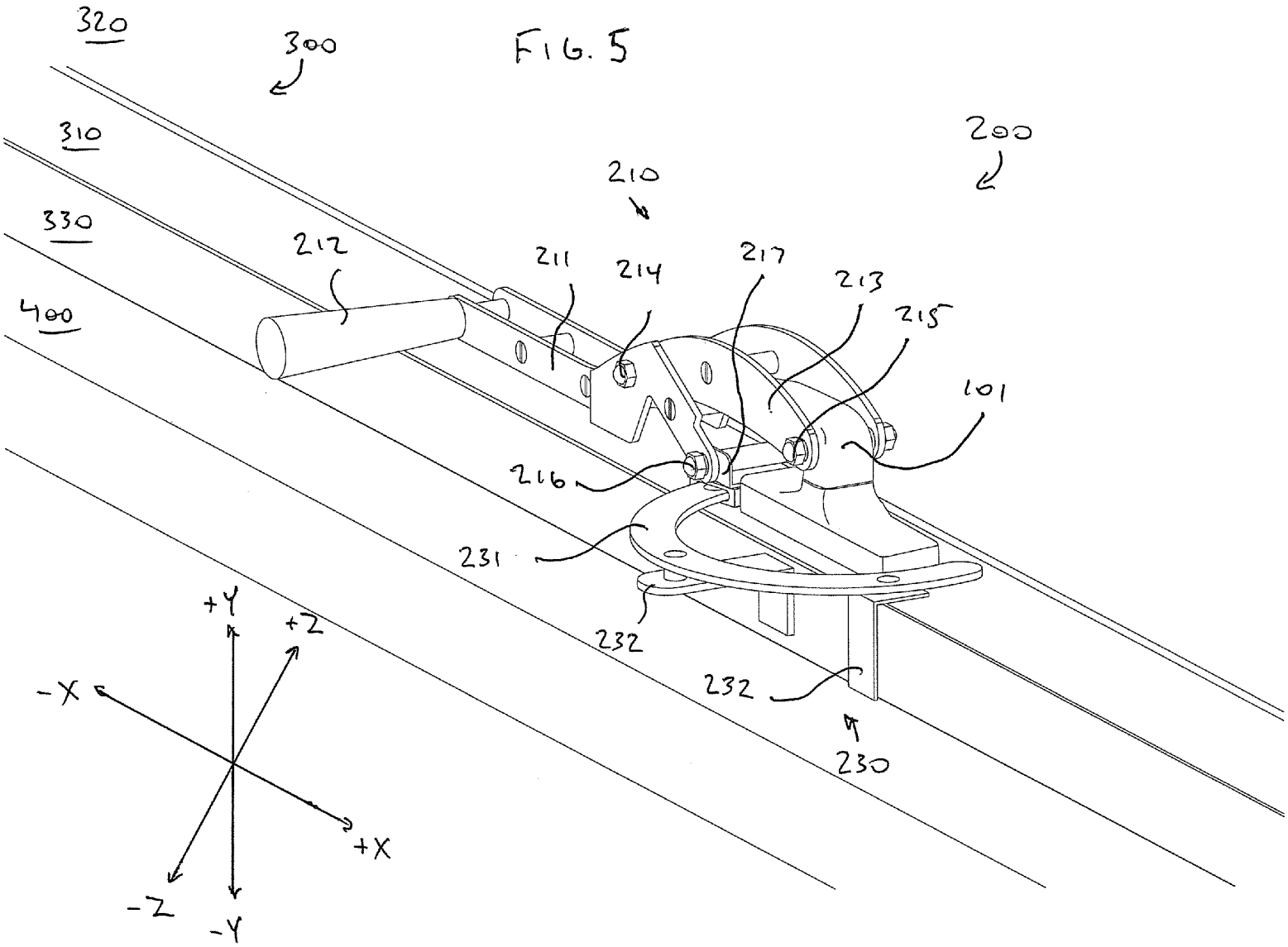
FIG. 5 is a diagram that illustrates a perspective view of an exemplary double-acting lever mechanism in a locked/closed position and comprising an exemplary lever and an exemplary stationary base in accordance with an embodiment of the present invention.
Figure 6:
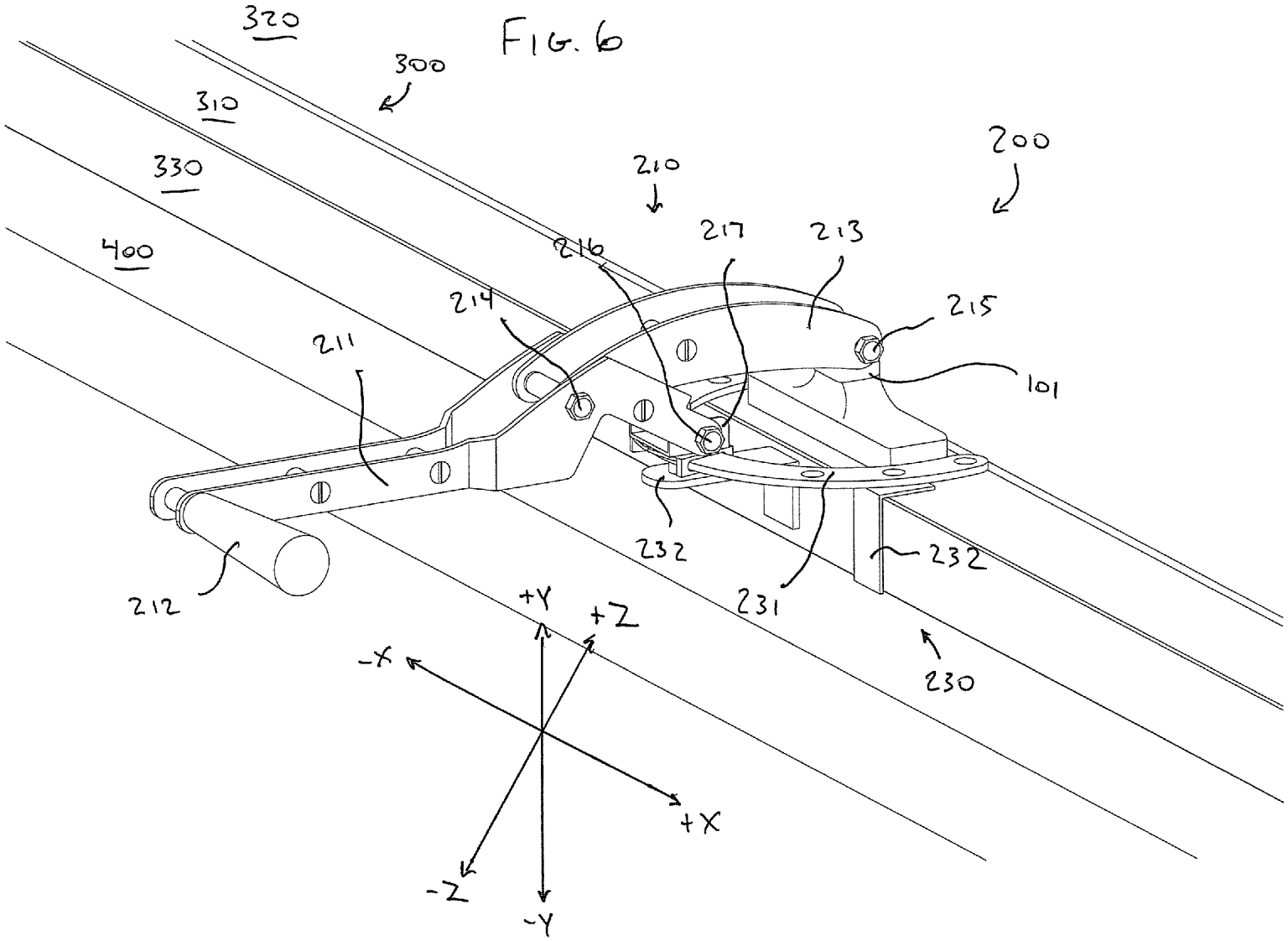
FIG. 6 is a diagram that illustrates a perspective view of an exemplary double-acting lever mechanism in an unlocked/closed position and comprising an exemplary lever and an exemplary stationary base in accordance with an embodiment of the present invention.
Figure 7:
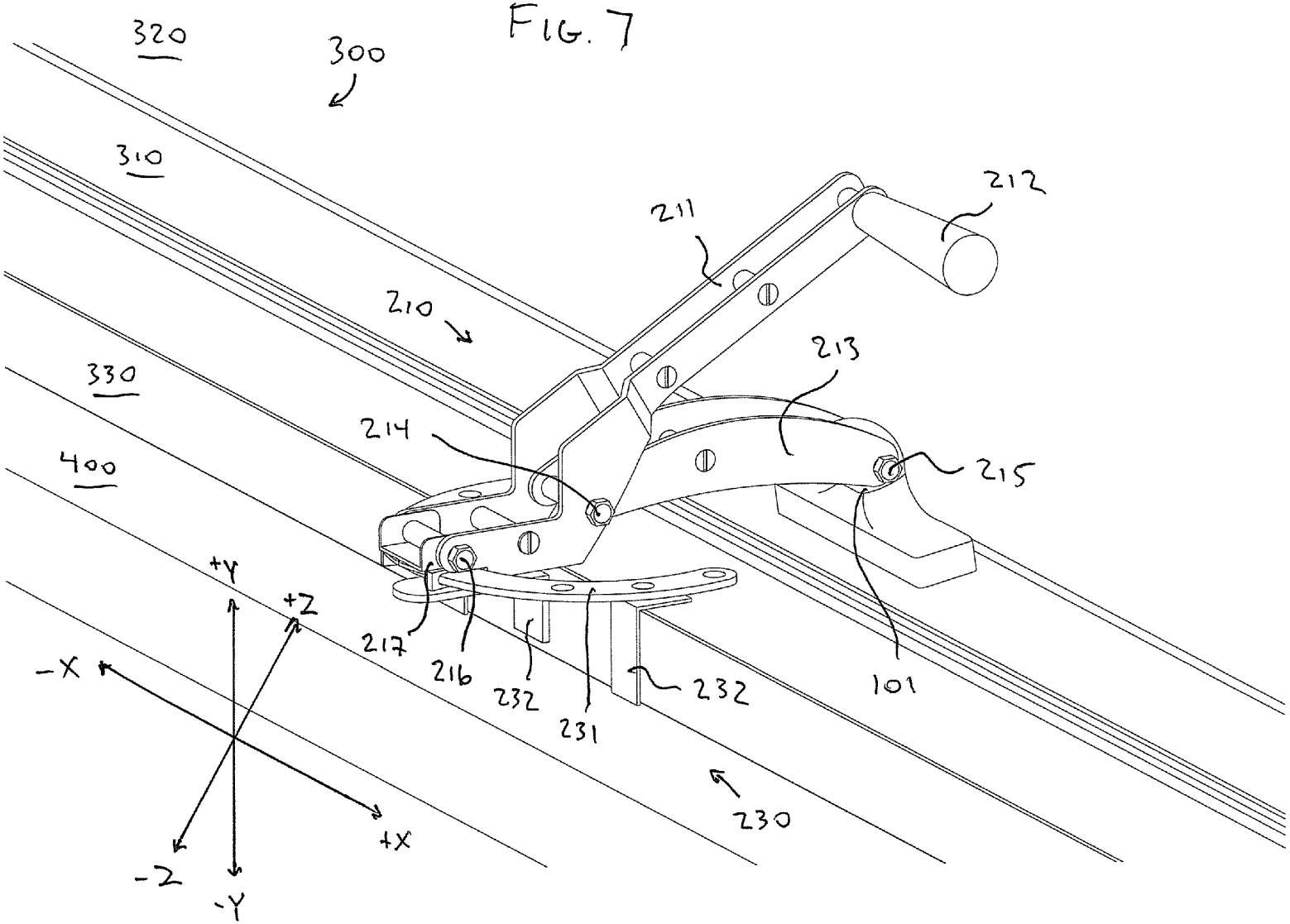
FIG. 7 is a diagram that illustrates a perspective view of an exemplary double-acting lever mechanism in an unlocked/open position and comprising an exemplary lever and an exemplary stationary base in accordance with an embodiment of the present invention.

FIG. 5 is a diagram that illustrates a perspective view of an exemplary double-acting lever mechanism 200 in a locked/closed position and comprising an exemplary lever 210 and an exemplary stationary base 230 in accordance with an embodiment of the present invention. FIG. 6 is a diagram that illustrates a perspective view of an exemplary double-acting lever mechanism 200 in an unlocked/closed position and comprising an exemplary lever 210 and an exemplary stationary base 230. FIG. 7 is a diagram that illustrates a perspective view of an exemplary double-acting lever mechanism 200 in an unlocked/open position and comprising an exemplary lever 210 and an exemplary stationary base 230.

Referring to FIGS. 5-7, there is shown an exemplary double-acting lever mechanism 200 comprising an exemplary lever 210 and an exemplary stationary base 230. Also illustrated in FIGS. 5-7 are a window frame 400 and a vent 300. The vent can comprise a sash 310, glass 320 and vent stop 330, for example. The exemplary double-acting lever mechanism 200 is illustrated in three-dimensions comprising an X axis, a Y axis and a Z axis. The −X direction refers to the left direction, for example. The +X direction refers to the right direction, for example. The −Y direction refers to the down direction, for example. The +Y direction refers to the up direction, for example. The −Z direction refers to the direction away from the glass 320, for example. The +Z direction refers to the direction toward the glass 320, for example. Although certain embodiments in the foregoing description may be described in reference to the various directions corresponding to left/right/down/up/away/toward, for example, the directions may correspond differently depending on the viewpoint and/or the positioning of the lever mechanism 200 with respect to the vent 300.

In certain embodiments, the stationary base 230 comprises a stationary track 231 and one or more stationary supports 232. The stationary track 231 may be substantially a semi-circle (e.g., approximately 180 degrees) or between approximately 90-200 degrees (e.g., a half of a semi-circle) and can at least partially wrap around a vent handle 101 or any suitable interface to a vent locking mechanism. In certain embodiments, the stationary track 231 may extend over, but not fixably attach to, sash 310, at least on one side of vent handle 101, such that lever 210 may be substantially parallel to glass 320 and substantially above sash 310 when in a locked position (as illustrated in FIG. 5). The stationary support(s) 232 attach to the stationary track 231 and one or more of the vent stop 330 and window frame 400. The stationary support(s) 232 supports the stationary track 231 in a fixed position about the vent handle 101.

In various embodiments, the stationary base 230 slidably attaches to lever 210 at a fulcrum connection 217, which allows the lever 210 to slide substantially ninety (90) degrees in the +X/−Z and −X/+Z directions, for example, between locked (as illustrated in FIG. 5) and unlocked (as illustrated in FIG. 6) positions, as discussed in more detail below.

Referring to FIGS. 2-7, there is shown an exemplary double-acting lever mechanism 200 comprising an exemplary lever 210 and an exemplary base 220, 230. Double-acting refers to the two separate and distinct actions (e.g., locking/unlocking and opening/closing) provided by the lever mechanism 200 by pivoting in two separate and distinct ninety (90) degree (i.e., 85-95 degrees) directions (e.g., +X/−Z to unlock and +Y/+Z to open or −Y/−Z to close and −X/+Z to lock).

Although FIGS. 2 and 5 illustrate a lever arm 211 of the lever mechanism 200 extending in the −X direction, the lever mechanism 200 could similarly be configured to extend in the +X direction. In other words, although FIGS. 2-3 and 5-6 illustrate unlocking as pivoting in the +X/−Z direction and locking as pivoting in the −X/+Z direction, in embodiments where the lever mechanism 200 is instead configured to extend in the +X direction, unlocking may be provided by pivoting in the −X/−Z direction and locking can be provided by pivoting in the +X/+Z, for example.

Although FIGS. 3-4 and 6-7 illustrate the lever mechanism 200 pivoting in the +Y/+Z direction to open the sash 310 and pivoting in the −Y/−Z direction to close the sash 310, in certain embodiments the lever mechanism may be configured to pivot in the +X/+Z direction to open the sash 310 and pivot in the −X/−Z direction to close the sash 310, or vice versa, among other things, by reconfiguring/rotating components of the lever 210 by approximately ninety (90) degrees, for example.

Referring again to FIGS. 2-7, in certain embodiments, the lever 210 may comprise a lever arm 211, a lever handle 212, a push arm 213, a lever arm pivot 214, a pivotable sash attachment 215, a fulcrum 216 and a fulcrum connection 217. In certain embodiments, the fulcrum connection 217 rotatably couples the lever 210 to the swing arm base 220 at swing arm housing 222 using a pin, screw or any suitable rotatable attachment mechanism. In various embodiments, the fulcrum connection 217 slidably attaches the lever 210 to the stationary base 230 at stationary track 231 using any suitable slidable attachment mechanism. The fulcrum connection 217 pivots with swing arm base 220 or slides with stationary base 230 between unlocked and locked positions (as illustrated in FIGS. 2-3 and 5-6).

In various embodiments, a first end of a push arm 213 of the lever 210 attaches to a vent handle 101, or any suitable interface to a vent locking mechanism, at pivotable sash attachment 215, which may be a pin, screw or any suitable pivotable attachment mechanism. In certain embodiments, the pivotable sash attachment 215 may be detachably coupled to the vent locking mechanism interface 101 using a quick release pin or any suitable releasable, pivotable attachment mechanism. A second end of the push arm 213 couples to a lever arm 211 at lever arm pivot 214, which may be a pin, screw or any suitable pivotable attachment mechanism.

The lever arm 211 attaches at one end to the fulcrum 216, which may be a pin, screw, or any suitable rotatable connection, at fulcrum connection 217. At the other end of the lever arm 211, a lever handle 212, which may be any suitable mechanism to grasp and pivot the lever 210, may be attached to or integrated with lever arm 211. In certain embodiments, the lever arm 211 may be telescopic and/or otherwise collapsible, foldable, or the like. In various embodiments, the lever handle 212 may be collapsible, foldable or the like.

In operation, when moving the lever 210 substantially ninety (90) degrees in the +X/−Z direction or the −X/+Z direction between a locked position (as illustrated in FIGS. 2 and 5) and an unlocked position (as illustrated in FIGS. 3 and 6) using the lever handle 213 (i.e., the first action of the double-acting lever mechanism 200), the lever 210 pivots at the pivotable sash attachment 215, and pivots with swing arm base 220 or slides with stationary base 230 at fulcrum connection 217.

In operation, when moving the lever 210 substantially ninety (90) degrees in the +Y/+Z direction or the −Y/−Z direction between an open position (as illustrated in FIGS. 4 and 7) and a closed position (as illustrated in FIGS. 3 and 6) using the lever handle 213 (i.e., the second action of the double-acting lever mechanism 200), the lever arm 211 pivots at the lever arm pivot 214 and the fulcrum 216, while the push arm 213 pivots at the lever arm pivot 214 and the pivotable sash attachment 215 to open or close the sash 310.

Figure 8:
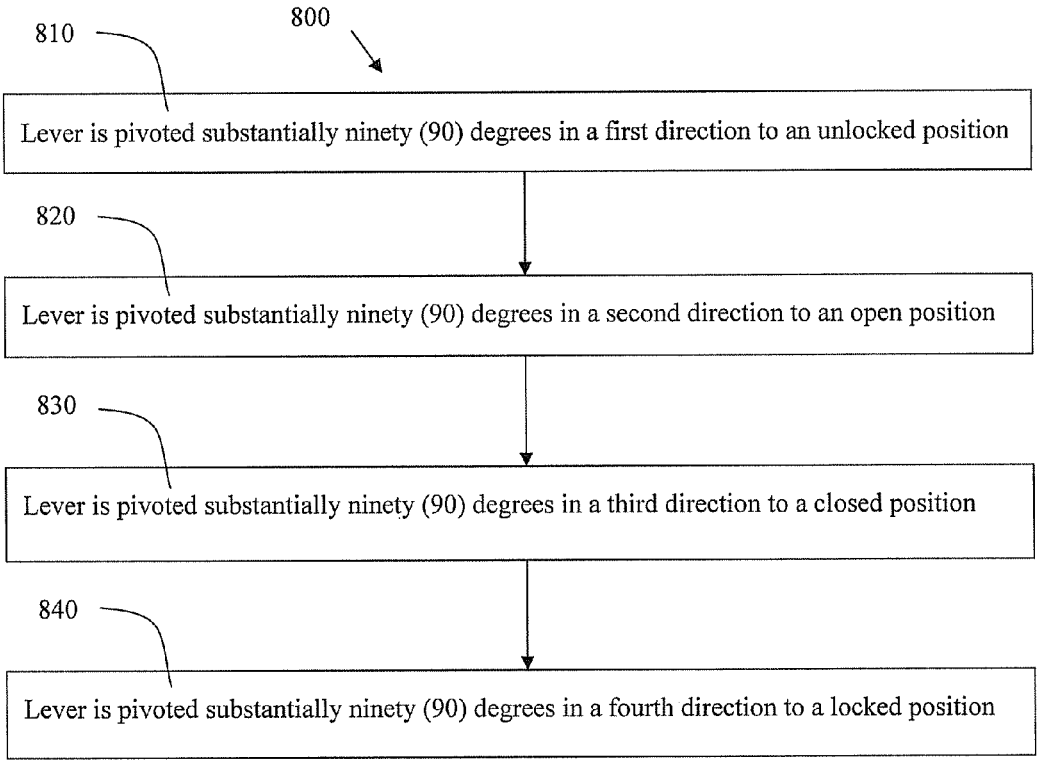
FIG. 8 is a flow diagram that illustrates exemplary steps for unlocking, opening, closing and locking a vent sash in accordance with an embodiment of the present invention.

FIG. 8 is a flow diagram that illustrates exemplary steps for unlocking, opening, closing and locking a vent sash 310 in accordance with an embodiment of the present invention. Referring to FIG. 8, there is shown a flow diagram 800, which illustrates exemplary steps for unlocking, opening, closing and locking a vent sash 310. At step 810, a lever 210 is pivoted substantially ninety (90) degrees in a first direction to an unlocked position. At step 820, the lever 210 is pivoted substantially ninety (90) degrees in a second direction to an open position. At step, 830, the lever 210 is pivoted substantially ninety (90) degrees in a third direction to a closed position. At step 840, the lever 210 is pivoted substantially ninety (90) degrees in a fourth direction to a locked position. Although the method is described with reference to the exemplary elements of the systems described above, it should be understood that other implementations are possible.

At step 810, a lever 210 is pivoted substantially ninety (90) degrees in a first direction to an unlocked position. In certain embodiments, the first direction may be the +X/−Z direction, although other directions are contemplated as discussed above. The lever 210 may be pivoted using the lever handle 213. Certain embodiments provide that the lever 210 pivots at the pivotable sash attachment 215, and pivots with swing arm base 220 or slides with stationary base 230 at fulcrum connection 217. The lever 210 may initially be positioned substantially parallel to glass 320 and over sash 310, and may pivot to a position substantially perpendicular to glass 320.

In embodiments employing a swing arm base 220, the swing arm base 220 pivots about the main swing arm pivot 221. Further, the secondary swing arm pivot support 225 pivots about the secondary swing arm pivot 224. The swing arm pivot support 225 contacts and biases the detent pin 223 towards a main swing arm pivot end of grooves 226, which locks and stabilizes the lever mechanism 200 in the unlocked position (as illustrated in FIGS. 3-4). At the same time, the biasing of the detent pin 223 towards the main swing arm pivot end of grooves 226 by the secondary swing arm pivot support 225 causes the support leg 228 portion of the detent pin 223 to contact the window frame 400, which provides further locking and stabilization of the lever mechanism 200 in the unlocked position (as illustrated in FIGS. 3-4).

At step 820, the lever 210 is pivoted substantially ninety (90) degrees in a second direction to an open position. In certain embodiments, the second direction may be the +Y/+Z direction, although other directions are contemplated as discussed above. In various embodiments, the second direction is different than the first direction. The lever 210 may be pivoted using the lever handle 213. Certain embodiments provide that the lever arm 211 pivots at the lever arm pivot 214 and the fulcrum 216, while the push arm 213 pivots at the lever arm pivot 214 and the pivotable sash attachment 215 to open the sash 310.

At step, 830, the lever 210 is pivoted substantially ninety (90) degrees in a third direction to a closed position. In certain embodiments, the third direction may be the −Y/−Z direction, although other directions are contemplated as discussed above. In various embodiments, the third direction is different than the first and second directions. In certain embodiments, the third direction is opposite the second direction. The lever 210 may be pivoted using the lever handle 213. Certain embodiments provide that the lever arm 211 pivots at the lever arm pivot 214 and the fulcrum 216, while the push arm 213 pivots at the lever arm pivot 214 and the pivotable sash attachment 215 to close the sash 310.

At step 840, the lever 210 is pivoted substantially ninety (90) degrees in a fourth direction to a locked position. In certain embodiments, the fourth direction may be the −X/+Z direction, although other directions are contemplated as discussed above. In various embodiments, the fourth direction is different than the first, second and third directions. In certain embodiments, the fourth direction is opposite the first direction. The lever 210 may be pivoted using the lever handle 213. Certain embodiments provide that the lever 210 pivots at the pivotable sash attachment 215, and pivots with swing arm base 220 or slides with stationary base 230 at fulcrum connection 217. The lever 210 may initially be positioned substantially perpendicular to glass 320, and may pivot to a position substantially parallel to glass 320 and over sash 310.

In embodiments employing a swing arm base 220, the swing arm base 220 pivots about the main swing arm pivot 221. Further, the secondary swing arm pivot support 225 pivots about the secondary swing arm pivot 224. The swing arm pivot support 225 pivots away from the detent pin 223, allowing the detent pin 223 to bias towards the secondary swing arm pivot end of grooves 226, which releases the locking and stabilization of the lever mechanism 200 such that it may pivot to the locked position (as illustrated in FIG. 2). At the same time, the biasing of the detent pin 223 back towards the secondary swing arm pivot end of grooves 226 releases the support leg 228 portion of the detent pin 223 from its contact with the window frame 400, which allows the lever mechanism 200 to pivot to the locked position (as illustrated in FIG. 2).

In certain embodiments, by configuring the vent arm 211 length and the position of the lever arm pivot 214, the force required to pivot the lever mechanism 200, to both lock/unlock and open/close the vent sash 310, does not exceed five (5) pounds (lbs.), irrespective of the size and weight of the vent sash 310. In various embodiments, pivoting the lever mechanism 200 substantially ninety (90) degrees in a first direction to lock/unlock a vent sash 310, and pivoting the lever mechanism 200 substantially ninety (90) degrees in a second direction to open/close the vent sash does not involve excessive twisting or turning of an operator's wrist.

Certain embodiments provide that the lever mechanism 200 may be retrofitted to fit an existing vent handle 101 or replace an existing vent handle 101 such that the lever mechanism 200 operates with an existing locking mechanism of a vent 300. Additionally and/or alternatively, the lever mechanism 200 may be manufactured as a part of a locking mechanism of a vent 300.

In certain embodiments, the lever 210 may restrict or limit the distance the vent sash 310 may open. Further, the lever 210 can help secure and support the vent sash 310 such that it does not blow out from negative pressure when in an open position. In various embodiments, the lever 210 and/or base 220, 230 may comprise a catch, lock, snap, or any suitable locking mechanism (not shown) configured to secure the lever 210 in the locked position and to provide additional compression and sealing of the vent sash 310.

Certain embodiments provide a lever mechanism system 200 for unlocking, opening, closing and locking a vent sash 310. The lever mechanism system 200 may comprise a base 220, 230 configured to fixably attach to one or more of a vent stop 330 and a window frame 400. The lever mechanism system 200 may comprise a lever 210 rotatably or slidably attached to the base 220, 230. The lever 210 may be configured to pivotably attach to a locking mechanism interface 101 of the vent sash 310. The lever 210 may be configured to pivot substantially ninety degrees in a first direction to an unlocked position. The lever 210 may be configured to pivot substantially ninety degrees in a second direction to an open position. The lever 210 may be configured to pivot substantially ninety degrees in a third direction to a closed position. The lever 210 may be configured to pivot substantially ninety degrees in a fourth direction to a locked position.

In various embodiments, the first, second, third and fourth directions are different directions.

In certain embodiments, the first direction is opposite the fourth direction.

In various embodiments, the second direction is opposite the third direction.

In certain embodiments, the locking mechanism interface may be a vent handle 101 of a locking mechanism.

In various embodiments, the locking mechanism comprises a plurality of locking points 108 for disengageably coupling to a corresponding plurality of keepers 107.

In certain embodiments, the lever 210 may comprise a push arm 213 including a first push arm end and a second push arm end. The first push arm end may be configured to pivotably attach to the locking mechanism interface 101 at a pivotable sash attachment 215. The second push arm end may be configured to pivotably attach to a lever arm 211 at a lever arm pivot 214. The lever 210 may comprise the lever arm including a first lever arm end and a second lever arm end. The first lever arm end may be configured to pivotably attach to a fulcrum 216 at a fulcrum connection 217. The second lever arm end at least one of attaches to a lever handle 212, and integrates with the lever handle 212. The lever 210 may comprise the fulcrum connection 217 configured to rotatably or slidably attach the lever 210 to the base 220, 230. The fulcrum connection 217 may rotate or slide with the base 220, 230 between the unlocked and the locked positions.

In various embodiments, the pivotable sash attachment 215 is a quick release pin detachably coupled to the locking mechanism interface 101.

In certain embodiments, the lever arm 211 is one or more of telescopic, collapsible, and foldable.

In various embodiments, the lever handle 212 is at least one of collapsible and foldable.

In certain embodiments, the lever 210 pivots at the pivotable sash attachment 215, and pivots or slides with the base 220, 230 at the fulcrum connection 217, when pivoting substantially ninety degrees in the first direction and the fourth direction between the locked position and the unlocked position using the lever handle 212.

In various embodiments, the lever arm 211 pivots at the lever arm pivot 214 and the fulcrum 216, and the push arm 213 pivots at the lever arm pivot 214 and the pivotable sash attachment 215, when pivoting the lever 210 substantially ninety degrees in the second direction and the third direction between the open position and the closed position using the lever handle 212.

In certain embodiments, the base 220 comprises a main swing arm pivot 221 configured to pivotably attach and extend through a swing arm housing 222. The main swing arm pivot 221 may fixably attach to one or more of the vent stop 330 and the window frame 400. The main swing arm pivot 221 supports the swing arm housing 222 when pivoting substantially ninety degrees in the first direction and the fourth direction between the locked position and the unlocked position. The main swing arm pivot 221 supports the lever 210 when pivoting substantially ninety degrees in the second direction and the third direction between the closed position and the open position.

The base 220 comprises the swing arm housing 222 configured to pivotably attach to the main swing arm pivot 221, a secondary swing arm pivot 224, and the lever 210. The swing arm housing 222 fits partially and rotatably within a secondary swing arm pivot support 225 attached to the secondary swing arm pivot 224. The swing arm housing 222 comprises a top portion groove 226 and a bottom portion groove 226. The top portion groove 226 and bottom portion groove 226 comprises a main swing arm pivot end and a secondary swing arm pivot end.

The base 220 comprises a detent pin 223 configured to extend through the top portion groove 226 and the bottom portion groove 226 of the swing arm housing 222. The detent pin 223 may be configured to attach to the secondary swing arm pivot 224 via a spring 227. A portion of the detent pin 228 extending through the bottom portion groove 226 is configured to engage the window frame 400 when the detent pin 223 is biased by the secondary swing arm pivot support 225 towards the main swing arm pivot end of the bottom portion groove 226. The portion of the detent pin 228 extending through the bottom portion groove 226 is configured to disengage the window frame 400 when the detent pin 223 is biased by the spring 227 to the secondary swing arm pivot end of the bottom portion groove 226.

In various embodiments, the base 230 comprises a stationary track 231 configured to at least partially wrap around the locking mechanism interface 101 and slidably attach to the lever 210. The stationary track 231 may be between ninety (90) and two hundred (200) degrees of a substantially semicircular shape. The base 230 may comprise one or more stationary supports 232 configured to attach to the stationary track 231 and one or more of the vent stop 330 and the window frame 400 to support the stationary track 231 in a fixed position.

In certain embodiments, a force applied to pivot the lever 210 substantially ninety degrees in each of the first direction, the second direction, the third direction and the fourth direction does not exceed five pounds.

In various embodiments, the lever 210 restricts an amount the vent sash is opened.

Various embodiments provide a method 800 for unlocking, opening, closing and locking a vent sash 310. The method may comprise pivoting 810 a lever 210 substantially ninety degrees in a first direction to an unlocked position. The method 800 may comprise pivoting 820 the lever 210 substantially ninety degrees in a second direction to an open position. The method 800 may comprise pivoting 830 the lever 210 substantially ninety degrees in a third direction to a closed position. The method 800 may comprise pivoting 840 the lever 210 substantially ninety degrees in a fourth direction to a locked position.

In certain embodiments, the first, second, third and fourth directions are different directions.

In various embodiments, the first direction is opposite the fourth direction.

In certain embodiments, the second direction is opposite the third direction.

In various embodiments, the lever 210 interfaces with a locking mechanism of the vent sash 310, the locking mechanism comprising a plurality of locking points 108 for disengageably coupling to a corresponding plurality of keepers 107.

In certain embodiments, the lever 210 attaches to a base 220, 230. The base 220, 230 may attach to one or more of a window frame 400 and a vent stop 330. The base 220, 230, may be one or more of a stationary base 230 and a pivotable swing arm base 220.

In various embodiments, a force applied to pivot the lever 210 substantially ninety degrees in each of the first direction, the second direction, the third direction and the fourth direction does not exceed five pounds.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A lever mechanism system, the system comprising:

a base directly attached to at least one of a vent stop and a window frame; and a lever having a first end and a second end, the lever comprising one or more of an integrated or attached lever handle at the first end, the lever rotatably or slidably attached directly to the base between the first end and the second end, and the lever pivotably attached at the second end to a vent sash via a locking mechanism interface located at the vent sash, the lever operable to at least:

pivot substantially ninety degrees in a first direction to move the locking mechanism interface to an unlocked position, wherein the locking mechanism interface engages a locking mechanism at the vent sash to unlock the vent sash, push forward in a second direction to push the locking mechanism interface and thereby the vent sash to a fully open position, pull backward in a third direction to pull the locking mechanism interface and thereby the vent sash to a fully closed position, and pivot substantially ninety degrees in a fourth direction to move the locking mechanism interface to a locked position wherein the locking mechanism interface engages the locking mechanism at the vent sash to lock the vent sash.

2. The lever mechanism system according to claim 1, wherein the first, second, third and fourth directions are different directions.

3. The lever mechanism system according to claim 1, wherein the first direction is opposite the fourth direction.

4. The lever mechanism system according to claim 1, wherein the second direction is opposite the third direction.

5. The lever mechanism system according to claim 1, wherein the locking mechanism interface is a vent handle of the locking mechanism.

6. The lever mechanism system according to claim 5, wherein the locking mechanism comprises a plurality of locking points for disengageably coupling to a corresponding plurality of keepers.

7. The lever mechanism system according to claim 1, the base comprising:

a main swing arm pivot configured to pivotably attach and extend through a swing arm housing, and fixably attach to at least one of the vent stop and the window frame, wherein the main swing arm pivot supports the swing arm housing when the lever is pivoting substantially ninety degrees in the first direction and the fourth direction between the locked position and the unlocked position, wherein the main swing arm pivot supports the lever when the lever is pushing forward in the second direction and pulling backward in the third direction between the closed position and the open position;

the swing arm housing configured to pivotably attach to the main swing arm pivot, a secondary swing arm pivot, and the lever, the swing arm housing fitting partially and rotatably within a secondary swing arm pivot support attached to the secondary swing arm pivot, wherein the swing arm housing comprises a top portion groove and a bottom portion groove, the top portion groove and bottom portion groove comprising a main swing arm pivot end and a secondary swing arm pivot end; and a detent pin configured to extend through the top portion groove and the bottom portion groove of the swing arm housing, and configured to attach to the secondary swing arm pivot via a spring, wherein a portion of the detent pin extending through the bottom portion groove is configured to engage the window frame when the detent pin is biased by the secondary swing arm pivot support towards the main swing arm pivot end of the bottom portion groove, and disengage the window frame when the detent pin is biased by the spring to the secondary swing arm pivot end of the bottom portion groove.

8. The lever mechanism system according to claim 1, wherein the base comprises:

a stationary track configured to at least partially wrap around the locking mechanism interface and slidably attach to the lever, the stationary track being between ninety and two hundred degrees of a substantially semi-circular shape; and at least one stationary support configured to attach to the stationary track and at least one of the vent stop and the window frame to support the stationary track in a fixed position.

9. The lever mechanism system according to claim 1, wherein a force applied to pivot the lever in each of the first direction, the second direction, the third direction and the fourth direction does not exceed five pounds.

10. The lever mechanism system according to claim 1, wherein the lever restricts an amount the vent sash is opened.

11. A lever mechanism system comprising:

a base attaching directly to at least one of a vent stop and a window frame; and a lever comprising:

a push arm comprising a first push arm end and a second push arm end, the first push arm end comprising a pivotable sash attachment pivotably attaching to a vent sash via a locking mechanism interface located at the vent sash, the second push arm end pivotably attached to a lever arm at a lever arm pivot;

the lever arm comprising a first lever arm end and a second lever arm end, the lever arm pivot being between the first lever arm end and the second lever arm end, the first lever arm end pivotably attached to a fulcrum at a fulcrum connection, the second lever arm end at least one of:

attaching to a lever handle, and integrating with the lever handle; and the fulcrum connection rotatably or slidably attaching the lever directly to the base.

12. The lever mechanism system according to claim 11, wherein the pivotable sash attachment is a quick release pin detachably coupled to the locking mechanism interface.

13. The lever mechanism system according to claim 11, wherein the lever arm is at least one of telescopic, collapsible, and foldable.

14. The lever mechanism system according to claim 11, wherein the lever handle is at least one of collapsible and foldable.

15. The lever mechanism system according to claim 11, wherein the lever pivots at the pivotable sash attachment, and pivots or slides with the base at the fulcrum connection, when pivoting substantially ninety degrees in a first direction and a fourth direction between a locked position and an unlocked position using the lever handle.

16. The lever mechanism system according to claim 11, wherein the lever arm pivots at the lever arm pivot and the fulcrum, and the push arm pivots at the lever arm pivot and the pivotable sash attachment, when pushing the lever forward in a second direction and pulling the lever backward in a third direction between an open position and a closed position using the lever handle.

17. A method for unlocking, opening, closing and locking a vent sash, the method comprising:

pivoting a lever substantially ninety degrees in a first direction to move a locking mechanism interface located at the vent sash to an unlocked position, wherein the locking mechanism interface engages a locking mechanism at the vent sash to unlock the vent sash;

pushing the lever forward in a second direction to push the locking mechanism interface and thereby the vent sash to a fully open position;

pulling the lever backward in a third direction to pull the locking mechanism interface and thereby the vent sash to a fully closed position; and pivoting the lever substantially ninety degrees in a fourth direction to move the locking mechanism interface to a locked position, wherein the locking mechanism interface engages the locking mechanism at the vent sash to lock the vent sash, wherein the lever comprises a first end and a second end, the lever having one or more of an integrated or attached lever handle at the first end, the lever rotatably or slidably attached directly to the base between the first end and the second end, and the lever pivotably attached at the second end to the vent sash via a locking mechanism interface located at the vent sash, and wherein the base is directly attached to at least one of a window frame or a vent stop.

18. The method according to claim 17, wherein the first, second, third and fourth directions are different directions.

19. The method according to claim 17, wherein the first direction is opposite the fourth direction.

20. The method according to claim 17, wherein the second direction is opposite the third direction.

21. The method according to claim 17, wherein the locking mechanism interface is configured to operate the locking mechanism comprising a plurality of locking points for disengageably coupling to a corresponding plurality of keepers.

22. The method according to claim 17, wherein the base is at least one of a stationary base and a pivotable swing arm base.

23. The method according to claim 17, wherein a force applied to pivot the lever in each of the first direction, the second direction, the third direction and the fourth direction does not exceed five pounds.

* * * * *